US010799743B2

(12) United States Patent
Zhu

(10) Patent No.: US 10,799,743 B2
(45) Date of Patent: Oct. 13, 2020

(54) TRAMPOLINE

(71) Applicant: Guoyi Zhu, Taishan (CN)

(72) Inventor: Guoyi Zhu, Taishan (CN)

( * ) Notice: Subject to any disclaimer, the term of this patent is extended or adjusted under 35 U.S.C. 154(b) by 0 days.

(21) Appl. No.: 16/435,561

(22) Filed: Jun. 10, 2019

(65) Prior Publication Data

US 2020/0094094 A1 Mar. 26, 2020

(30) Foreign Application Priority Data

Sep. 23, 2018 (CN) ..... 2018 1 1111328
Apr. 11, 2019 (CN) ..... 2019 1 0289364
Apr. 11, 2019 (CN) ..... 2019 1 0289365

(51) Int. Cl.
*A63B 5/11* (2006.01)
*A63B 21/04* (2006.01)

(52) U.S. Cl.
CPC ..... *A63B 5/11* (2013.01); *A63B 21/0428* (2013.01)

(58) Field of Classification Search
CPC .. A63B 5/11; A63B 2067/005; A63B 5/08–11
See application file for complete search history.

(56) References Cited

U.S. PATENT DOCUMENTS 3,233,895 A * 2/1966 Grelle ..... A63B 5/11 482/27
3,983,585 A 10/1976 Sidlinger
5,275,578 A * 1/1994 Adams ..... A63B 5/11 24/713.6
5,385,518 A * 1/1995 Turner ..... A63B 5/11 482/23
6,001,045 A 12/1999 Gift et al.
8,974,350 B2 3/2015 Hsiang
10,307,628 B2 * 6/2019 Tseng ..... A63B 5/11
2019/0154115 A1 * 5/2019 Mehr ..... A63B 5/11

FOREIGN PATENT DOCUMENTS

WO 2014058364 A1 4/2014

* cited by examiner

*Primary Examiner* — Nyca T Nguyen
(74) *Attorney, Agent, or Firm* — Bayramoglu Law Offices LLC

(57) ABSTRACT

A trampoline includes a plurality of arc-shaped rods and a plurality of long iron joints. The long iron joints are T-shaped. The arc-shaped rods and the long iron joints are insertedly connected to each other successively and alternatively to form a circular ring. Lower ends of the long iron joints are insertedly connected to straight tubes. Lower ends of two adjacent straight tubes are insertedly connected to a foot tube. The foot tube is U-shaped with an opening upward. The arc-shaped rods are connected to a fabric clamp through arc-shaped hook springs. The fabric clamp inner end is connected to an edge of the trampoline fabric. Grooves are insertedly connected in the inward protrusions, preventing the arc-shaped rods from rotating relative to the horizontal tube. The fabric clamp outer sheet closes the interval between the tension spring and the trampoline fabric, preventing users from stepping into the interval.

7 Claims, 7 Drawing Sheets

TRAMPOLINE

CROSS REFERENCE TO THE RELATED APPLICATIONS

This application is based upon and claims priorities of Chinese Application No. 201811111328.5, filed on Sep. 23, 2018, Chinese Application No. 201910289364.9, filed on Apr. 11, 2019, and Chinese Application No. 201910289365.3, filed on Apr. 11, 2019, the entire contents of which are incorporated herein by reference.

TECHNICAL FIELD

The present invention relates to the technical field of a trampoline, specifically relates to a trampoline.

BACKGROUND

In the process of use, arc-shaped rods of trampolines have a twisting phenomenon under an action of force, seriously affecting the stability of the trampoline. For fitting a traditional iron joint, an arc-shaped rod has to be processed into a retracted-head shape, requiring to go through a beating process, thus the process is time-consuming and laborious, affecting the processing efficiency.

A tension spring of a traditional trampoline is hung on a triangular ring. The triangular ring is sleeved with a fabric strip, and the fabric strip is then sewed onto an edge of a trampoline fabric. The processing efficiency is low, and the labor cost is high. In addition, since there is no barrier between the trampoline fabric and an edge of the trampoline, a user is prone to step into intervals, easily causing danger.

The user needs to count corresponding numbers of springs and spring holes during an installation of the springs of the traditional trampoline. If the number of the springs is not equal to the number of the spring holes, it will result in a failed installation. Moreover, the spring holes are small, so it's difficult to hang spring hooks into the spring holes, thus wasting time and labor, and affecting the production efficiency.

Besides, an installation of protective nets of the existing trampoline is complicated, and parts of the protective nets have bad protective effect.

SUMMARY

The objective of the present invention is to provide a trampoline, so as to solve the problems proposed in the above-mentioned prior art.

In order to achieve the above objective, the present invention provides the following technical solution. A trampoline includes a plurality of arc-shaped rods and a plurality of long iron joints. The long iron joints are T-shaped. The arc-shaped rods and the long iron joints are insertedly connected to each other successively and alternatively to form a circular ring. Lower ends of the long iron joints are insertedly connected to straight tubes. Lower ends of two adjacent straight tubes are insertedly connected to a foot tube. The foot tube is U-shaped with an opening upward. The arc-shaped rods are connected to a fabric clamp through an arc-shaped hook spring, and an inner end of the fabric clamp is connected to an edge of the trampoline fabric.

The fabric clamp includes a fabric clamp outer sheet and a clamping sheet. A lower end of the fabric clamp outer sheet is provided with concave and convex stripes. An upper end face of the clamping sheet is also provided with concave and convex stripes. A front end of the clamping sheet is bent downward, and a tail end of a bending part of the clamping sheet is provided with a tension spring hanging hole. The fabric clamp outer sheet and the clamping sheet are processed on a surface of the trampoline fabric by hot-pressing with a high-frequency welding machine. Two sides of each long iron joint are compressed inward to form inward protrusions. An outer wall of each arc-shaped rod is provided with grooves symmetrically. The each arc-shaped rod is inserted in the inward protrusions through the grooves.

The arc-shaped hook spring includes a spring main body. An end of the spring main body is provided with a hook. The other end of the spring main body is integratedly provided with an arc-shaped hook. A tail end of the arc-shaped hook is vertically bent into a horizontal hook. The hook is hooked and connected inside a hole of the fabric clamp. The fabric clamp is fixedly connected to the edge of the trampoline fabric. The horizontal hook is hooked and connected in a groove of the arc-shaped rod. A lowest protective rod is fixed on the arc-shaped rod.

Preferably, an upper end of the each long iron joint is an arc-shaped hollow tube horizontally configured. The arc-shaped rods are inserted into the long iron joints along two sides of the arc-shaped hollow tube.

Preferably, two ends of the each long iron joint and two ends of the each arc-shaped rod are respectively provided with through holes. The grooves are inserted in the inward protrusions, and the through holes coincide with each other for fixed connection by bolts.

Preferably, an upper end of the lowest protective rod is provided with a protective net tube, the protective net tube is inserted and fixed in the lowest protective rod with screws, and a protective net is installed on the protective net tube.

Preferably, a side of a square hole of the straight tube is insertedly connected to an L-shaped protective net fixing part, and an end of the L-shaped protective net fixing part is connected to a fixed nut. Gaskets are provided on the L-shaped protective net fixing part at both sides of the straight tube. An upper end of the L-shaped protective net fixing part is sleeved with a fixed sleeve, the fixed sleeve is sleeved with the protective net tube, and the protective net is installed on the protective net tube.

Preferably, an upper end of the straight tube is insertedly connected to a thread head. A right end of the thread head is connected to an L-shaped spring. A left end of the thread head is fixed through a nut. An upper end of the L-shaped spring is insertedly connected to a spring sleeve. The spring sleeve is sleeved with a protective net tube, and the protective net is installed on the protective net tube.

Preferably, the straight tube is connected to an U-shaped spring leaf through a bolt. A right end of the screw is connected to a nut. A right end of the U-shaped spring leaf is fixedly connected to a connective insertion rod. The connective insertion rod is insertedly connected to an insertion rod sleeve. The insertion rod sleeve is sleeved with a protective net tube, and the protective net is installed on the protective net tube.

The present invention has the following advantages. For the trampoline, the grooves are configured to improve the flex resistance of the arc-shaped rod. The grooves are inserted in the inward protrusions, preventing the arc-shaped rods from rotating relative to the horizontal tube to cause danger during use. The fabric clamp outer sheet can close the interval between the tension spring and the trampoline fabric to prevent the users from stepping into the interval, playing a protective role. Owing to the high-frequency welding process and the concave and convex stripes configured on the fabric clamp, the strength of the trampoline is higher than that manufactured by the traditional processing method, and the processing efficiency is high. The horizontal hook provided at an end of the spring effectively makes it hang on the arc-shaped rod with grooves, facilitating the use without the need of corresponding to the spring holes of the arc-shaped rods, and capable of being hung on the arc-shaped rods randomly. The users can install and use the trampoline more convenient and faster. The structure of the provided protective net is convenient for installation and has a good protecting effect.

1, arc-shaped rod, 11, groove, 2, long iron joint, 21, inward protrusion, 22, through hole, 3, straight tube, 4, foot tube, 5, arc-shaped hook spring, 51, spring main body, 52, hook, 53, arc-shaped hook, 54, horizontal hook, 6, fabric clamp, 61 fabric clamp outer sheet, 62, clamping sheet, 63, concave and convex stripe, 64, tension spring hanging hole, 7, trampoline fabric, 8, protective net tube, 9, the lowest protective rod, 101, L-shaped protective net fixing part, 102, fixing sleeve, 103, gasket, 104, fixed nut, 201, L-shaped spring, 202, thread head, 203, spring sleeve, 301, U-shaped spring leaf, 302, connective insertion rod, 303, insertion rod sleeve, 304, bolt.

DETAILED DESCRIPTION OF THE EMBODIMENTS

The technical solutions of the embodiments of the present invention are described clearly and completely hereinafter with reference to the drawings in the embodiments of the present invention. Obviously, the described embodiments are merely a part of embodiments according to the invention, rather than all. All other embodiments made by those of ordinary skill in the art without creative work based on the embodiments of the present invention should also be considered as falling within the scope of the present invention.

Embodiment 1

Figure 1:
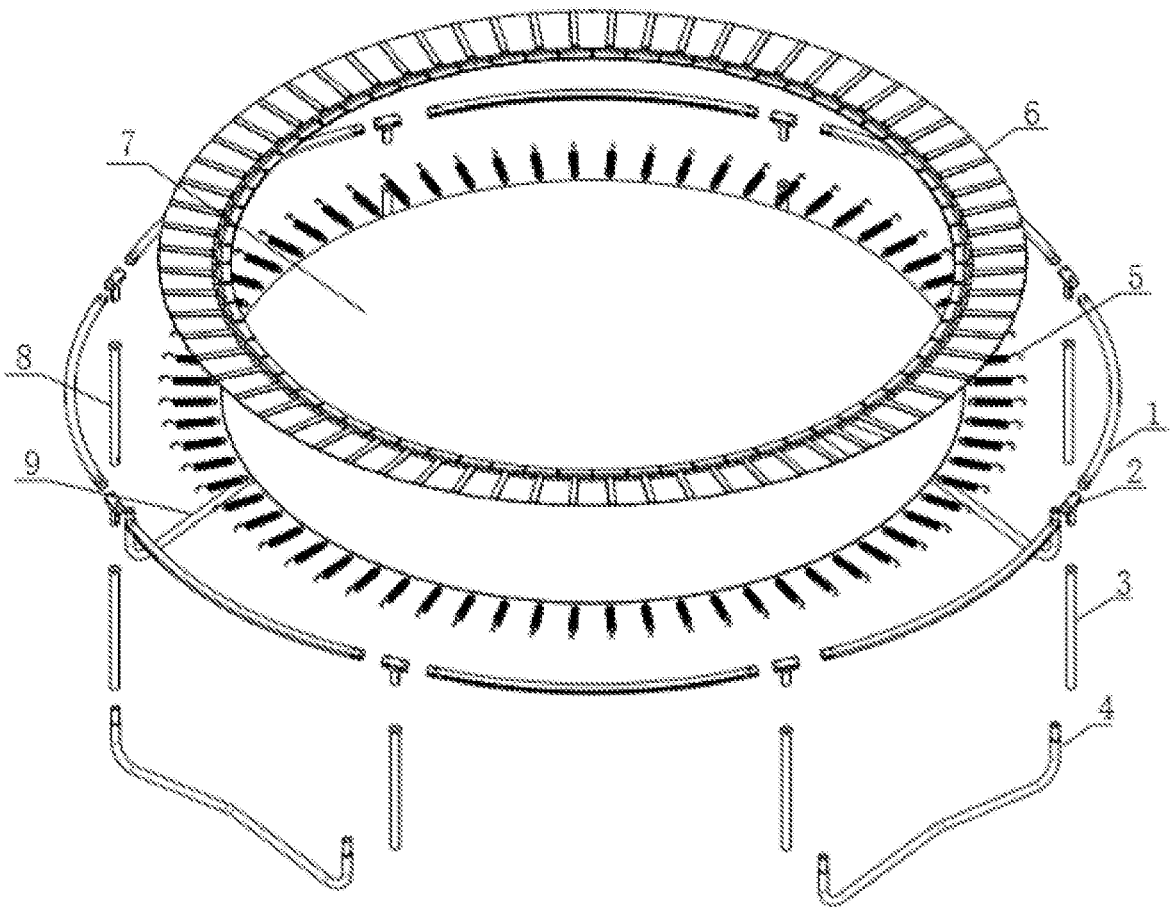
FIG. 1 is a structural diagram of the present invention.
Figure 2:
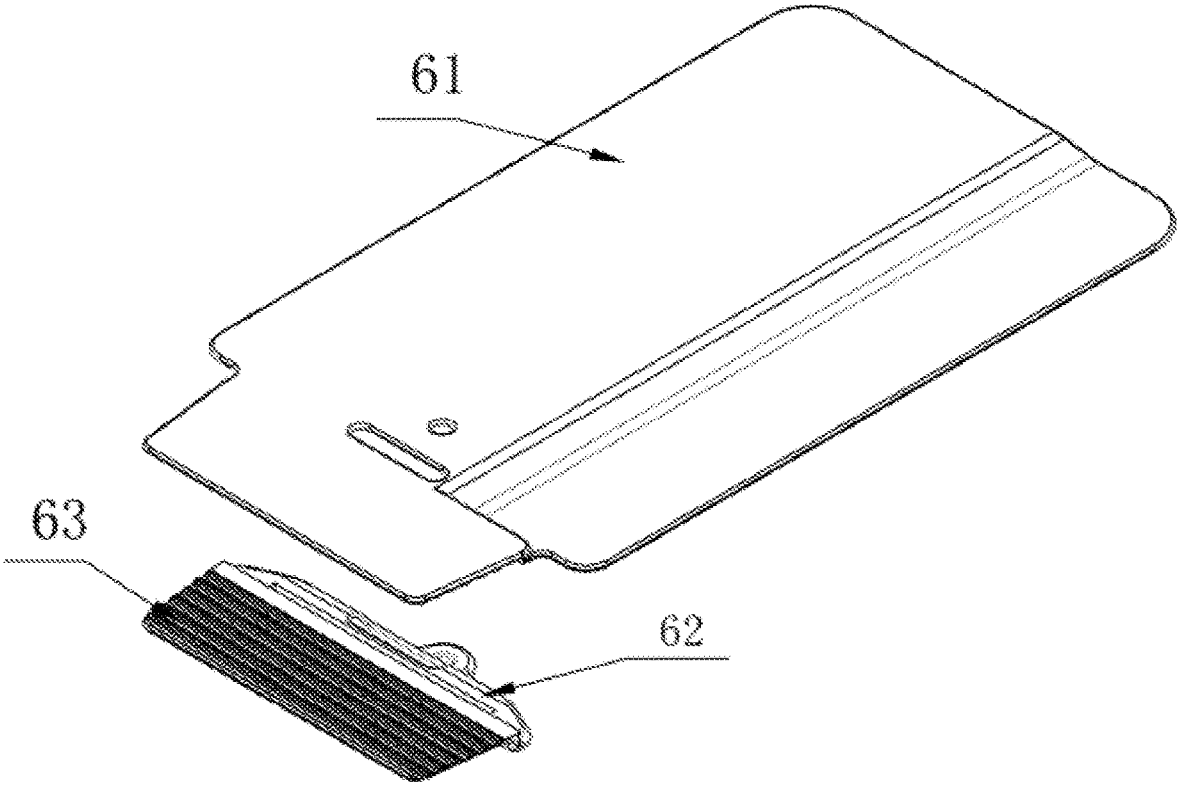
FIG. 2 is a structural diagram of a fabric clamp of the present invention.
Figure 3:
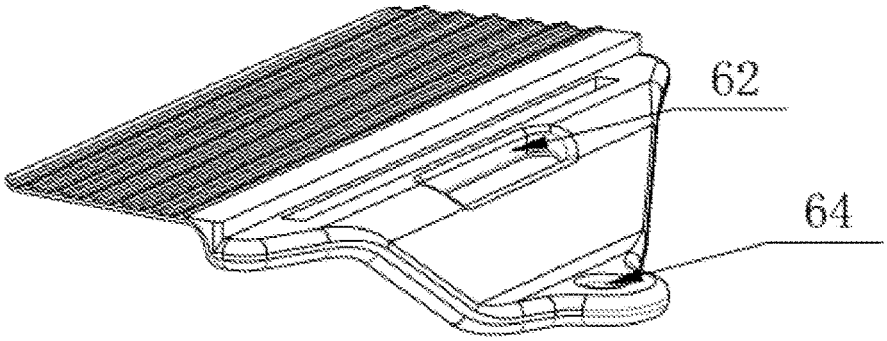
FIG. 3 is a structural diagram of a clamping sheet of the present invention.
Figure 4:
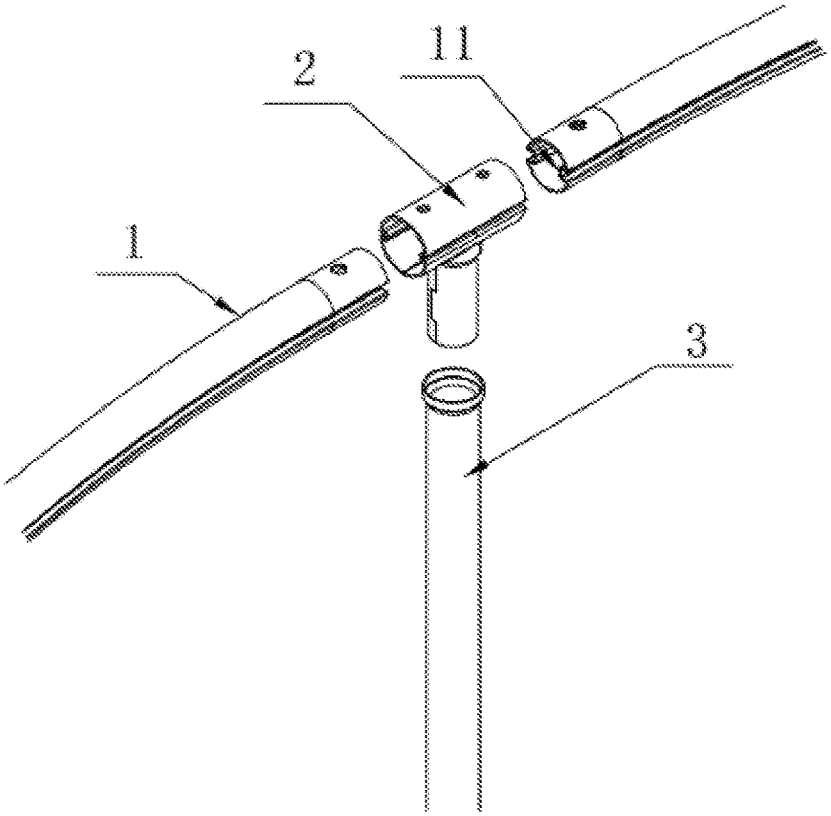
FIG. 4 is a schematic diagram of a connection structure of a long iron joint of the present invention.
Figure 5:
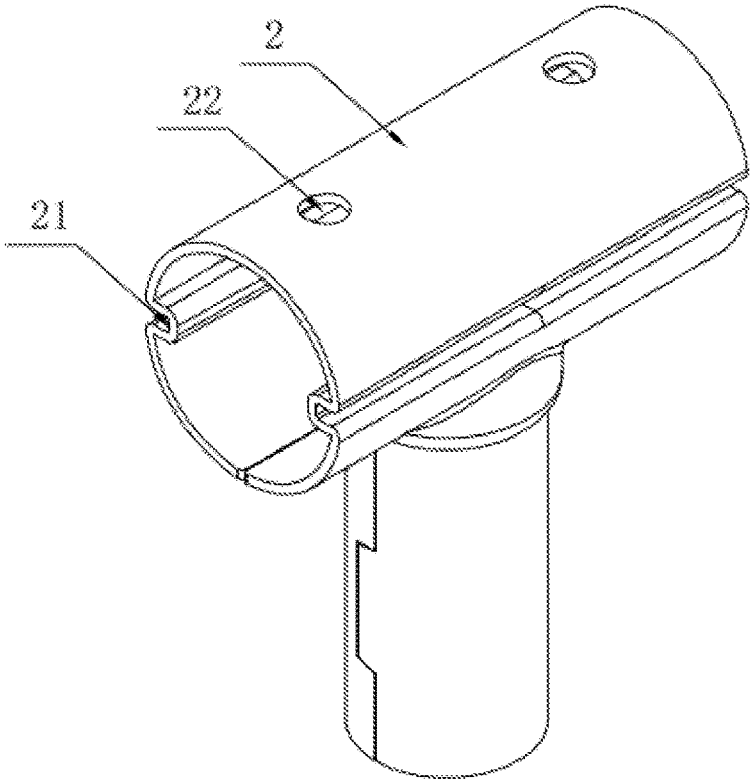
FIG. 5 is a structural diagram of a long iron joint of the present invention.
Figure 6:
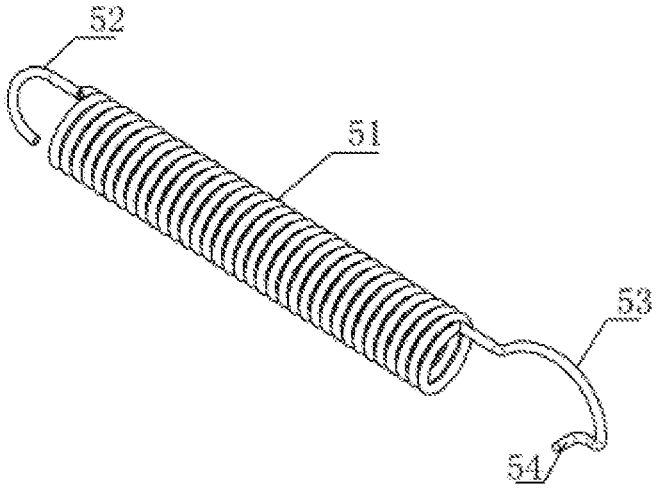
FIG. 6 is a structural diagram of an arc-shaped hook spring of the present invention.
Figure 7:
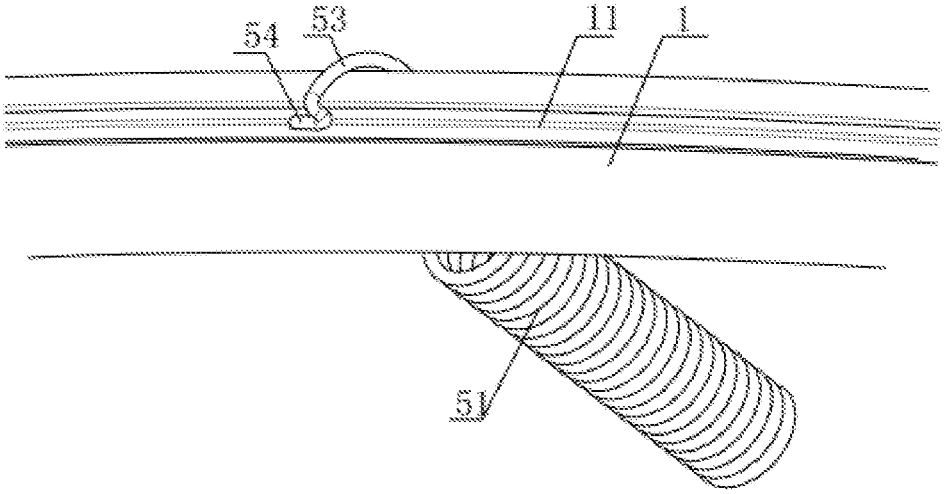
FIG. 7 is a structural diagram of a connection between an arc-shaped rod and a horizontal hook of the present invention.

The present invention provides a trampoline as shown in FIG. 1-FIG. 7, including a plurality of arc-shaped rods 1 and a plurality of long iron joints 2. The long iron joints 2 are T-shaped. The arc-shaped rods 1 and the long iron joints 2 are insertedly connected to each other successively and alternatively to form a circular ring. Lower ends of the long iron joints 2 are insertedly connected to the straight tubes 3. Lower ends of two adjacent straight tubes 3 are inserted in the foot tube 4. The foot tube 4 is U-shaped with an opening upward. The arc-shaped rod 1 is connected to the fabric clamp 6 through the arc-shaped hook spring 5, and an inner end of the fabric clamp 6 is connected to an edge of the trampoline fabric 7.

The fabric clamp 6 includes the fabric clamp outer sheet 61 and the clamping sheet 62. A lower end of the fabric clamp outer sheet 61 is provided with the concave and convex stripes 63. An upper end face of the clamping sheet 62 is also provided with the concave and convex stripes 63. A front end of the clamping sheet 62 is bent downward, and a tail end of a bending part of the clamping sheet is provided with the tension spring hanging hole 64. The fabric clamp outer sheet 61 and the clamping sheet 62 are processed on a surface of the trampoline fabric by hot-pressing with a high-frequency welding machine. Two sides of the long iron joint 2 are compressed inward to form the inward protrusions 21. An outer wall of the arc-shaped rod 1 is provided with the grooves 11 symmetrically. The arc-shaped rod 1 is inserted in the inward protrusions 21 through the grooves 11.

The arc-shaped hook spring 5 includes the spring main body 51. An end of the spring main body 51 is provided with the hook 52. The other end of the spring main body 51 is provided with the arc-shaped hook 53. A tail end of the arc-shaped hook 53 is vertically bent to form the horizontal hook 54. The hook 52 is hooked and connected inside a hole of the fabric clamp 6. The fabric clamp 6 is fixedly connected to the edge of the trampoline fabric 7. The horizontal hook 54 is hooked and connected in the groove 11 of the arc-shaped rod 1. The lowest protective rod 9 is fixed on the arc-shaped rod 1. An upper end of the lowest protective rod 9 is provided with the protective net tube 8, and the protective net tube 8 is inserted and fixed in the lowest protective rod 9 with screws. The protective net is provided on the protective net tube 8. The lowest protective rod 9 is used to limit a maximum expansion and contraction quantity to avoid a damage of the trampoline fabric 7 caused by excessive extension.

Specifically, an upper end of the long iron joint 2 is an arc-shaped hollow tube horizontally configured. The arc-shaped rods 1 are inserted into the long iron joints 2 along two sides of the arc-shaped hollow tube.

Specifically, two ends of the long iron joint 2 and two ends of the arc-shaped rod 1 are respectively provided with through holes 22. The grooves 11 are inserted in the inward protrusions 21, and the through holes 22 coincide with each other for a fixed connection by bolts.

Embodiment 2

Figure 8:
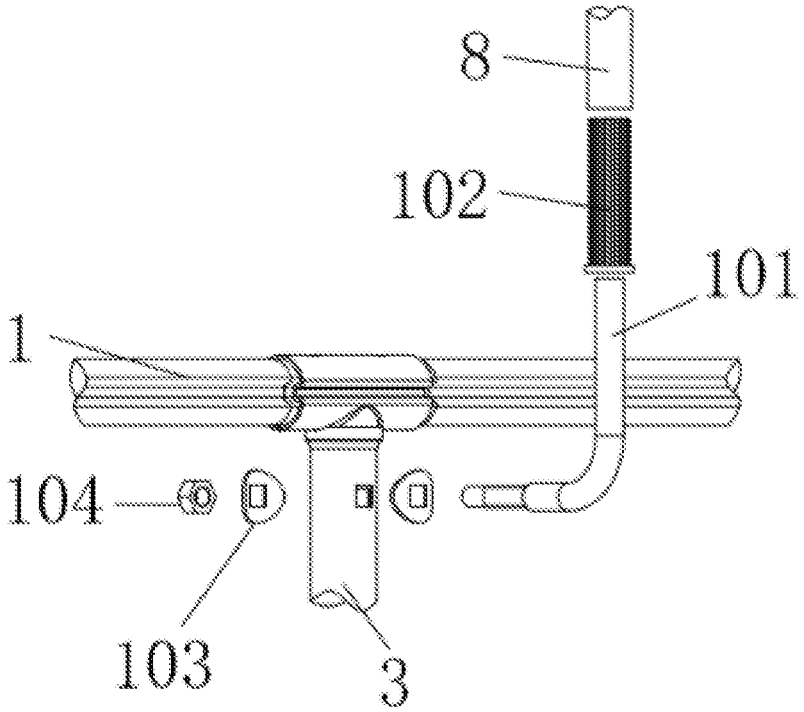
FIG. 8 is a structural diagram of an installation of an L-shaped protective net fixing part of the present invention.

The present invention provides a trampoline as shown in FIG. 1-FIG. 8, including a plurality of arc-shaped rods 1 and a plurality of long iron joints 2. The long iron joints 2 are T-shaped. The arc-shaped rods 1 and the long iron joints 2 are insertedly connected to each other successively and alternatively to form a circular ring. Lower ends of the long iron joints 2 are insertedly connected to straight tubes 3. Lower ends of two adjacent straight tubes 3 are insertedly connected to the foot tube 4. The foot tube 4 is U-shaped with an opening upward. The arc-shaped rod 1 is connected to the fabric clamp 6 through the arc-shaped hook spring 5, and an inner end of the fabric clamp 6 is connected to the edge of the trampoline fabric 7.

The fabric clamp 6 includes the fabric clamp outer sheet 61 and the clamping sheet 62. A lower end of the fabric clamp outer sheet 61 is provided with the concave and convex stripes 63. An upper end face of the clamping sheet 62 is also provided with the concave and convex stripes 63. A front end of the clamping sheet 62 is bent downward, and a tail end of a bending part of the clamping sheet is provided with the tension spring hanging hole 64. The fabric clamp outer sheet 61 and the clamping sheet 62 are processed on a surface of the trampoline fabric by hot-pressing with a high-frequency welding machine. Two sides of the long iron joint 2 are compressed inward to form the inward protrusions 21. An outer wall of the arc-shaped rod 1 is provided with the grooves 11 symmetrically. The arc-shaped rods 1 are inserted in the inward protrusions 21 through the grooves 11.

The arc-shaped hook spring 5 includes the spring main body 51. An end of the spring main body 51 is provided with the hook 52. The other end of the spring main body 51 is integratedly provided with the arc-shaped hook 53. A tail end of the arc-shaped hook 53 is vertically bent to form the horizontal hook 54. The hook 52 is hooked and connected inside a hole of the fabric clamp 6. The fabric clamp 6 is fixedly connected to the edge of the trampoline fabric 7. The horizontal hook 54 is hooked and connected in the groove 11 of the arc-shaped rod 1. The lowest protective rod 9 is fixed on the arc-shaped rod 1. A side of a square hole of the straight tube 3 is insertedly connected to the L-shaped protective net fixing part 101, and an end of the L-shaped protective net fixing part 101 is threadedly connected to the fixed nut 104. The gaskets 103 are provided on the L-shaped protective net fixing part 101 at both sides of the straight tube 3. An upper end of the L-shaped protective net fixing part 101 is sleeved with the fixing sleeve 102. The fixing sleeve 102 is sleeved with the protective net tube 8, and the protective net is installed on the protective net tube 8.

Specifically, an upper end of the long iron joint 2 is an arc-shaped hollow tube horizontally configured. The arc-shaped rods 1 are plugged into the long iron joints 2 along two sides of the arc-shaped hollow tube.

Specifically, two ends of the long iron joint 2 and two ends of the arc-shaped rod 1 are respectively provided with the through holes 22. The grooves 11 are inserted in the inward protrusions 21, and the through holes 22 coincide with each other for a fixed connection by bolts.

Embodiment 3

Figure 9:
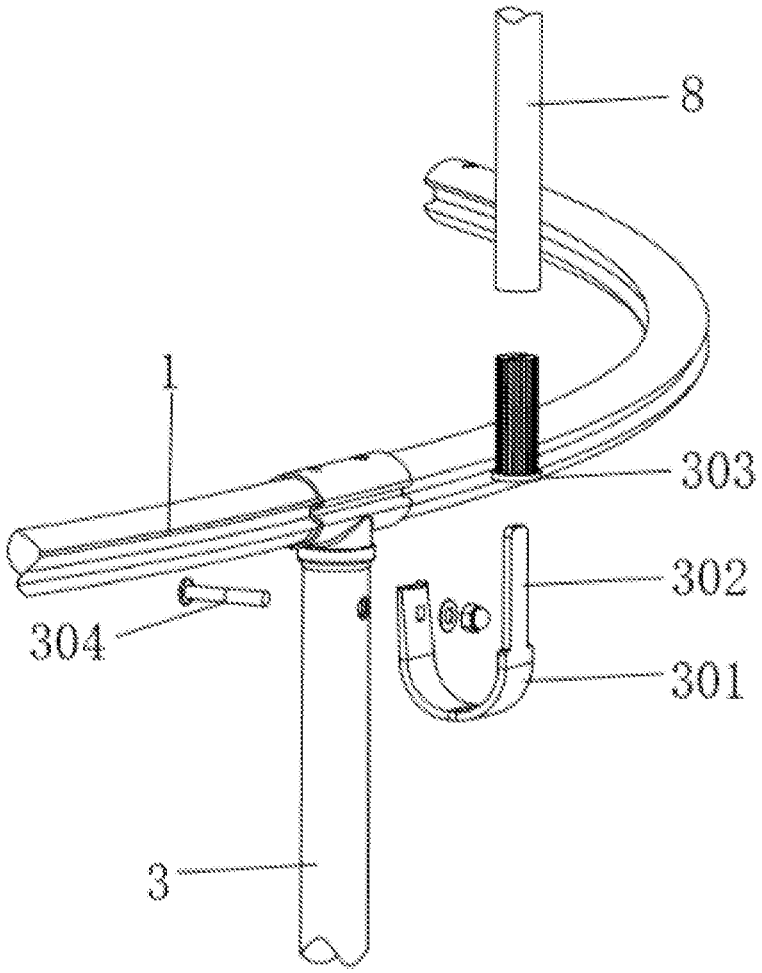
FIG. 9 is a structural diagram of an installation of an L-shaped spring of the present invention.

The present invention provides a trampoline as shown in FIG. 1-FIG. 7 and FIG. 9, including a plurality of arc-shaped rods 1 and a plurality of long iron joints 2. The long iron joints 2 are T-shaped. The arc-shaped rods 1 and the long iron joints 2 are insertedly connected to each other successively and alternatively to form a circular ring. Lower ends of the long iron joints 2 are insertedly connected to the straight tubes 3. Lower ends of two adjacent straight tubes 3 are insertedly connected to the foot tube 4. The foot tube 4 is U-shaped with an opening upward. The arc-shaped rod 1 is connected to the fabric clamp 6 through the arc-shaped hook spring 5, and an inner end of the fabric clamp 6 is connected to an edge of the trampoline fabric 7.

The fabric clamp 6 includes the fabric clamp outer sheet 61 and the clamping sheet 62. A lower end of the fabric clamp outer sheet 61 is provided with the concave and convex stripes 63. An upper end face of the clamping sheet 62 is also provided with the concave and convex stripes 63. A front end of the clamping sheet 62 is bent downward, and a tail end of a bending part of the clamping sheet is provided with the tension spring hanging hole 64. The fabric clamp outer sheet 61 and the clamping sheet 62 are processed on a surface of the trampoline fabric by hot-pressing with a high-frequency welding machine. Two sides of the long iron joint 2 are compressed inward to form the inward protrusions 21. An outer wall of the arc-shaped rod 1 is provided with the grooves 11 symmetrically. The arc-shaped rods 1 are inserted in the inward protrusions 21 through the grooves 11.

The arc-shaped hook spring 5 includes the spring main body 51. An end of the spring main body 51 is provided with the hook 52. The other end of the spring main body 51 is provided with the arc-shaped hook 53. A tail end of the arc-shaped hook 53 is vertically bent to form the horizontal hook 54. The hook 52 is hooked and connected inside a hole of the fabric clamp 6. The fabric clamp 6 is fixedly connected to the edge of the trampoline fabric 7. The horizontal hook 54 is hooked and connected in the groove 11 of the arc-shaped rod 1. The lowest protective rod 9 is fixed on the arc-shaped rod 1. An upper end of the straight tube 3 is insertedly connected to the thread head 202. A right end of the thread head 202 is connected to the L-shaped spring 201. A left end of the thread head 202 is fixed through a nut. An upper end of the L-shaped spring 201 is insertedly connected to the spring sleeve 203. The spring sleeve 203 is sleeved with the protective net tube 8, and the protective net is installed on the protective net tube 8.

Specifically, an upper end of the long iron joint 2 is an arc-shaped hollow tube horizontally configured. The arc-shaped rods 1 are inserted into the long iron joint 2 along two sides of the arc-shaped hollow tube.

Specifically, two ends of the long iron joint 2 and two ends of the arc-shaped rod 1 are respectively provided with the through holes 22. The grooves 11 are insertedly connected in the inward protrusions 21, and the through holes 22 coincide with each other for a fixed connection by bolts.

Embodiment 4

Figure 10:
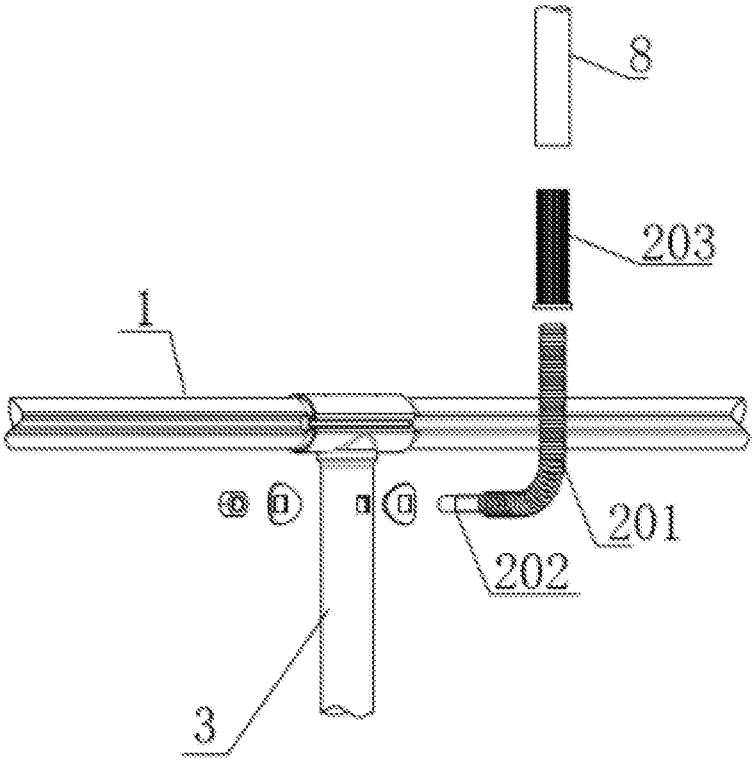
FIG. 10 is a structural diagram of an installation of a U-shaped spring leaf of the present invention.

The present invention provides a trampoline as shown in FIG. 1-FIG. 7 and FIG. 10, including a plurality of arc-shaped rods 1 and a plurality of long iron joints 2. The long iron joints 2 are T-shaped. The arc-shaped rods 1 and the long iron joints 2 are insertedly connected to each other successively and alternatively to form a circular ring. Lower ends of the long iron joints 2 are insertedly connected to the straight tubes 3. Lower ends of two adjacent straight tubes 3 are insertedly connected to the foot tube 4. The foot tube 4 is U-shaped with an opening upward. The arc-shaped rod 1 is connected to the fabric clamp 6 through the arc-shaped hook spring 5, and an inner end of the fabric clamp 6 is connected to an edge of the trampoline fabric 7.

The fabric clamp 6 includes the fabric clamp outer sheet 61 and the clamping sheet 62. A lower end of the fabric clamp outer sheet 61 is provided with the concave and convex stripes 63. An upper end face of the clamping sheet 62 is also provided with the concave and convex stripes 63. A front end of the clamping sheet 62 is bent downward, and a tail end of a bending part of the clamping sheet is provided with the tension spring hanging hole 64. The fabric clamp outer sheet 61 and the clamping sheet 62 are processed on a surface of the trampoline fabric 7 by hot-pressing with a high-frequency welding machine. Two sides of the long iron joint 2 are compressed inward to form the inward protrusions 21. An outer wall of the arc-shaped rod 1 is provided with the grooves 11 symmetrically. The arc-shaped rods 1 are insertedly connected in the inward protrusions 21 through the grooves 11.

The arc-shaped hook spring 5 includes the spring main body 51. An end of the spring main body 51 is provided with the hook 52. The other end of the spring main body 51 is provided with the arc-shaped hook 53. A tail end of the arc-shaped hook 53 is vertically bent to form the horizontal hook 54. The hook 52 is hooked and connected inside a hole of the fabric clamp 6. The fabric clamp 6 is fixedly connected to the edge of the trampoline fabric 7. The horizontal hook 54 is hooked and connected in the groove 11 of the arc-shaped rod 1. The lowest protective rod 9 is provided on the arc-shaped rod 1. The straight tube 3 is connected to the U-shaped spring leaf 301 through the bolt 304. A right end of the bolt 304 is connected to a nut. A right end of the U-shaped spring leaf 301 is fixedly connected to the connective insertion rod 302. The connective insertion rod 302 is insertedly connected to the insertion rod sleeve 303. The insertion rod sleeve 303 is sleeved with the protective net tube 8, and the protective net is installed on the protective net tube 8.

Specifically, an upper end of the long iron joint 2 is an arc-shaped hollow tube horizontally configured. The arc-shaped rods 1 are inserted into the long iron joints 2 along two sides of the arc-shaped hollow tube.

Specifically, two ends of the long iron joint 2 and two ends of the arc-shaped rod 1 are respectively provided with the through holes 22. The grooves 11 are insertedly connected in the inward protrusions 21, and the through holes 22 coincide with each other for a fixed connection by bolts.

Finally, it should be noted that, the above-mentioned descriptions are merely the preferred embodiments of the invention, rather than limit the scope of the present invention. Although the present invention has been illustrated in detail with reference to the above-mentioned embodiments, for those skilled in the art, modifications or equivalent substitutions may be made to the described technical solutions of the embodiments. Any modifications, equivalent substitutions, or improvement made without departing from the spirit and principle of the invention should be considered as falling within the scope of the present invention.

What is claimed is:

1. A trampoline, comprising: a plurality of arc-shaped rods and a plurality of long iron joints;

wherein the plurality of long iron joints are T-shaped, the plurality of arc-shaped rods and the plurality of long iron joints are insertedly connected to each other successively and alternatively to form a circular ring, lower ends of the plurality of long iron joints are insertedly connected to straight tubes, lower ends of two adjacent straight tubes are insertedly connected to a foot tube, the foot tube is U-shaped with an opening upward, the plurality of arc-shaped rods are connected to a fabric clamp through a plurality of arc-shaped hook springs, and an inner end of the fabric clamp is connected to an edge of a trampoline fabric;

the fabric clamp comprises an fabric clamp outer sheet and a clamping sheet, a lower end of the fabric clamp outer sheet is provided with first concave and convex stripes, an upper end face of the clamping sheet is provided with second concave and convex stripes, a front end of the clamping sheet is bent downward, and a tail end of a bending part of the clamping sheet is provided with a tension spring hanging hole, the fabric clamp outer sheet and the clamping sheet are processed on a surface of the trampoline fabric by hot-pressing, two sides of each long iron joint of the plurality of long iron joints are compressed inward to form inward protrusions, an outer wall of each arc-shaped rod of the plurality of arc-shaped rods is provided with grooves symmetrically, the plurality of arc-shaped rods are inserted in the plurality of long iron joints through a cooperation between the inward protrusions and the grooves; and each of the plurality of arc-shaped hook springs comprises a spring main body, a first end of the spring main body is provided with a hook, a second end of the spring main body is provided with an arc-shaped hook, a tail end of the arc-shaped hook is vertically bent to form a horizontal hook, the hook is hooked and connected inside the tension spring hanging hole of the fabric clamp, the fabric clamp is fixedly connected to the edge of the trampoline fabric, the horizontal hook is hooked and connected in one of the grooves of the each arc-shaped rod; a lowest protective rod is fixed on the each arc-shaped rod.

2. The trampoline according to claim 1, wherein an upper end of the each long iron joint is an arc-shaped hollow tube horizontally configured, and the plurality of arc-shaped rods are insertedly connected to the plurality of long iron joints along two sides of the arc-shaped hollow tube.

3. The trampoline according to claim 1, wherein two ends of the each long iron joint and two ends of the each arc-shaped rod are respectively provided with through holes, the grooves are insertedly connected in the inward protrusions, and the through holes coincide with each other for a fixed connection by bolts.

4. The trampoline according to claim 1, wherein an upper end of the lowest protective rod is insertedly connected to a protective net tube, the protective net tube is fixed with screws, and a protective net is installed on the protective net tube.

5. The trampoline according to claim 1, wherein a side of a square hole of each straight tube of the straight tubes is insertedly connected to an L-shaped protective net fixing part, and an end of the L-shaped protective net fixing part is connected to a fixed nut, gaskets are provided on the L-shaped protective net fixing part at both sides of the each straight tube, an upper end of the L-shaped protective net fixing part is sleeved with a fixing sleeve, the fixing sleeve is sleeved with a protective net tube, and a protective net is installed on the protective net tube.

6. The trampoline according to claim 1, wherein an upper end of each straight tube of the straight tubes is insertedly connected to a thread head, a right end of the thread head is connected to an L-shaped spring, a left end of the thread head is fixed through a nut, an upper end of the L-shaped spring is insertedly connected to a spring sleeve, the spring sleeve is sleeved with a protective net tube, and a protective net is installed on the protective net tube.

7. The trampoline according to claim 1, wherein each straight tube of the straight tubes is connected to an U-shaped spring leaf through a bolt, a right end of the bolt is connected to a nut, a right end of the U-shaped spring leaf is fixedly connected to a connective insertion rod, the connective insertion rod is insertedly connected to a insertion rod sleeve, the insertion rod sleeve is sleeved with a protective net tube, and a protective net is installed on the protective net tube.

* * * * *